United States Patent [19]

Sharp

[11] Patent Number: 4,951,844

[45] Date of Patent: Aug. 28, 1990

[54] DOUBLE WALLED CYLINDRICAL-SHAPED STORAGE TANK WITH INDEPENDENT MONITORING OF TANK AREAS

[76] Inventor: Bruce R. Sharp, 7685 Fields-Ertel Rd., Cincinnati, Ohio 45241

[21] Appl. No.: 450,524

[22] Filed: Dec. 14, 1989

[51] Int. Cl.[5] ..... B65D 6/00

[52] U.S. Cl. ..... 220/469; 220/1 B; 220/5 A; 220/444

[58] Field of Search ..... 220/1 B, 5 A, 18, 444, 220/466, 469

[56] References Cited

U.S. PATENT DOCUMENTS

| | | | |
|---|---|---|---|
| 3,335,903 | 2/1964 | Anderson | 220/83 |
| 3,700,512 | 2/1967 | Pearson et al. | 156/62.4 |
| 4,561,292 | 12/1985 | Pugnale et al. | 73/49.2 |
| 4,568,925 | 2/1986 | Butts | 340/605 |
| 4,579,617 | 4/1986 | Öberg et al. | 220/466 X |
| 4,653,312 | 3/1987 | Sharp | 220/469 X |
| 4,660,738 | 4/1987 | Ives | 220/1 B X |
| 4,685,327 | 8/1987 | Sharp | 220/469 X |
| 4,817,817 | 4/1989 | Palazzo | 220/469 X |
| 4,819,821 | 4/1989 | Sharp | 220/444 |
| 4,825,687 | 5/1989 | Sharp | 220/444 X |
| 4,844,287 | 7/1989 | Long | 220/469 X |
| 4,871,078 | 10/1989 | Sharp | 220/466 X |

FOREIGN PATENT DOCUMENTS 1272830 7/1968 Fed. Rep. of Germany .

*Primary Examiner*—Steven M. Pollard
*Attorney, Agent, or Firm*—Charles R. Wilson

[57] ABSTRACT

A cylindrical-shaped storage tank with substantially flattened ends is jacketed in a manner which results in storage tank system capable of holding detecting liquid or being placed under nonatmospheric pressure without structural damage. The storage tank initially has end plates mounted on its flattened ends. Thereafter, a separating agent is applied over the side walls of the storage tank, a layer of fibrous reinforcing material applied on the separating agent and the end plates, and a resinous material applied. The resultant jacket is independent from the side walls of the inner tank. True secondary containment is provided by the end plates and jacket. A fail safe containment storage tank system is provided by the use of independent leak detection means to monitor the closed space between the storage tank and end plates and the closed annular space between the storage tank and jacket for tank or jacket leakage.

13 Claims, 2 Drawing Sheets

DOUBLE WALLED CYLINDRICAL-SHAPED STORAGE TANK WITH INDEPENDENT MONITORING OF TANK AREAS

This invention relates to storage tanks. More particularly, the invention relates to underground storage tanks which have a jacket for secondary containment means.

BACKGROUND OF THE INVENTION

Commercial and industrial storage tanks are widely used for storing a great variety of liquids. Some of these liquids are highly corrosive and/or are flammable. The service life of a storage tank will vary, depending upon environmental conditions, including the liquid being stored. Eventually, however, the tank will become corroded and develop leaks. This can result in a significant danger to the environment and health of nearby residents. For example, storage tanks are commonly used for storing gasoline at service stations. Gasoline is highly flammable and is capable of posing a significant health and safety hazard if not properly contained. Federal as well as local regulations govern the structure of such storage tanks.

Heightened public awareness of the danger posed by storage tanks (particularly underground gasoline storage tanks) has led to additional governmental regulations. Recent proposed regulations will soon require most storage tanks to have secondary containment means and possibly a fail safe design feature to guard against accidental soil, water, and air contamination. Secondary containment means must be capable of containing leaked liquid from the storage tank. Rigid double walled tanks have been suggested as one alternative. While effective for containment purposes, such tanks, as presently available, are costly to build and difficult to install because of their weight. Such tanks are built by basically forming two rigid tanks utilizing different sized, reusable molds and then placing one tank inside the other.

Single and double walled tanks made from fiberglass reinforced resinous material are built using a number of distinct time consuming steps. In all known methods, a cylindrical-shaped, reusable mold is used to build tank halves which are subsequently assembled. Initially, layers of fiberglass followed by a resinous coating are applied to the mold or chopped fiberglass/resin streams are simultaneously directed onto the mold and subsequently cured. Sufficient applications of the fiberglass and resin are made until a wall thickness is obtained which has the desired strength. Next, support rib molds of cardboard, four to six inches wide, are placed completely around the cylinder at approximately sixteen inch intervals. Fiberglass and resin are then applied over the cardboard molds and onto adjacent areas of the cylinder so as to become a part of the inner tank shell. The mold is finally removed. The cylindrical-shaped wall, including the ribs and one end of the tank, are produced in this stage of the method. The above steps are repeated to obtain a second half-tank. The two half-tanks are then joined together by appropriate sealing means. The resultant single walled tank is capable of being installed in the ground and, in fact, is of the type which has been extensively used for the past twenty years.

In more recent years, double walled tanks have been built and used. Essentially, these tanks are built by the same method as the single walled tanks. An inner rigid tank is formed in the above described manner. Next, a larger diameter reusable mold is used to build a horizontal half-tank. The fiberglass/resin is applied in a known manner to the mold and cured to form the half-tank. A second horizontal half-tank is formed. Next, the completed inner tank is placed into the larger diameter half-tank. The ribs on the inner tank are properly dimensioned to act as spacer ribs between the two tanks. The second larger diameter half-tank is placed over the inner tank, joined and sealed at the seams with its matching half-tank. The resultant product is a double walled storage tank system comprised of essentially two rigid tanks, one inside the other.

A second method of making double walled fiberglass reinforced resinous tanks is similar to the above method and is just as time consuming and costly. In this method, the mold has a design wherein the ribs are formed as the fiberglass and resin material is applied. After forming the inner tank of which the ribs are an integral part thereof, the mold is removed. The interior portion of the tank next has a fiberglass/resin layer applied over the rib recesses to result in a smooth cylindrical-shaped interior. A second half-tank is formed in the same manner and the two halves joined. A cylindrical-shaped outer tank is then formed in horizontal halves. The formed inner tank and outer tank halves are assembled as in the first method described above to form a double walled storage tank system based on two rigid tanks with support ribs therebetween.

As is readily apparent, building a double walled storage tank system by known methods is very labor intensive and costly. Recent concerns about leaked tanks has heightened the need for an efficient and economical manner of building a double walled storage tank system. A jacketed storage tank system, as disclosed in my U.S. Pat. No. 4,523,454 also provides secondary containment means and avoids the problems associated with the rigid double walled systems. Additionally, the aforementioned jacket system features a fail-safe design due to the fact it provides continuous monitoring means whereby the integrity of both the primary and secondary containment means are checked to insure that leakage of either containment means is known when it first occurs.

Currently-built double walled fiberglass tank do not have sufficient structural strength to be shipped and installed with an annular space between the walls filled with liquid. Currently fiberglass tanks are shipped with a vacuum in the annular space to hold the inner and outer tank shell together to prevent separation of either wall from the ribs placed between the walls.

There has now been discovered methods whereby new and used storage tanks with flat ends are provided with end caps and a fibrous reinforced resinous jacket. The space between the storage tank and the newly formed secondary containment areas over the tank's main body and the end caps are separately monitored for leakage.

SUMMARY OF THE INVENTION

A method of adding secondary containment capability to a cylindrical-shaped storage tank having substantially flattened ends comprises the steps of (a) mounting end plates on each flattened end in a manner which isolates the area covered by each end plate, (b) applying a separating agent to the side walls of the storage tank, (c) applying a layer of a fibrous reinforcing material onto the separating agent and the end plates of the storage tank, and (d) applying a resinous material onto or with the reinforcing material. When the resinous material is cured, a jacket is formed which covers the storage tank, thereby providing secondary containment for any liquid which may leak from the storage tank. The closed annular space between the storage tank and the jacket and the closed end spaces between the storage tank and end plates are independently monitored for any leakage.

DETAILED DESCRIPTION OF THE INVENTION

While the description to follow describes the invention in terms of its use with underground storage tanks, it should be understood the invention has applicability for other uses as well. However, the invention lends itself particularly well to underground storage tanks used for storing liquid gasoline and, therefore, this preferred use is described in the following paragraphs.

Figure 1:
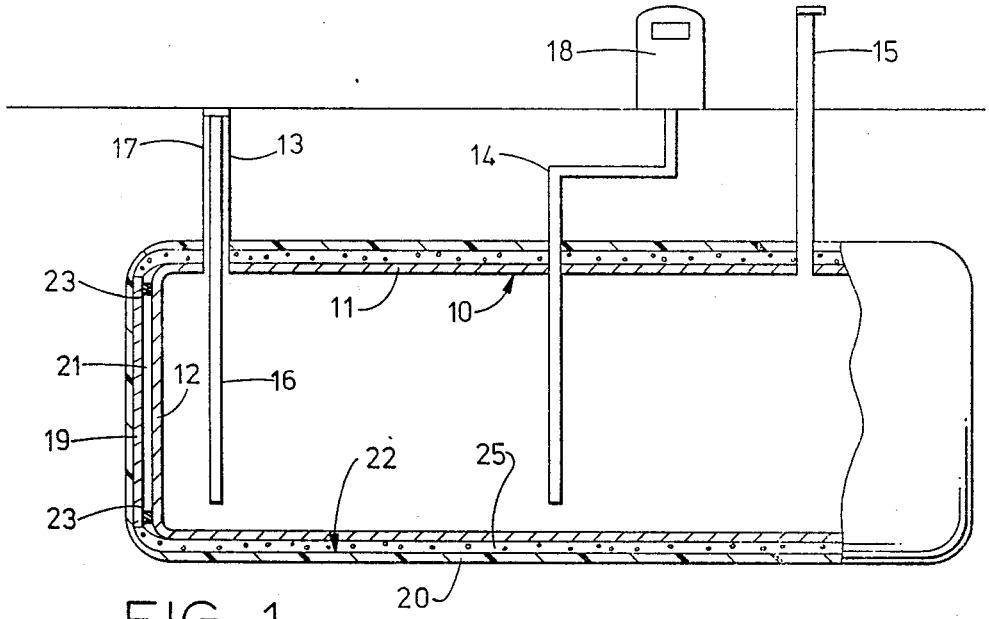
FIG. 1 is a side view in partial section of a cylindrical-shaped storage tank with flattened ends with end plates mounted thereon and having a fibrous reinforced resinous material as a jacket completely surrounding the tank.

With reference to FIG. 1, there is shown an underground storage tank system. The inner storage tank 10 of the type shown in FIG. 1 is well known and widely used, especially in the gasoline service station industry. Such tanks are cylindrical-shaped and are typically made of metal or, more recently, a fiberglass reinforced resin material. Either type of tank has use in this invention. The storage tank used in this invention has a cylindrical-shaped main body 11 and flattened ends 12. A typical metal storage tank is shown in FIG. 1. Sufficient openings are found in the storage tank 10 to allow for various access lines to communicate with the interior of the tank. As shown, lines 13, 14, and 15 are a fill pipe, dispensing line and vent pipe, respectively.

The fill pipe 13 provides as its obvious function the means by which gasoline can be pumped into the inner tank from an outside source, e.g. a tank truck. As illustrated in FIG. 1, fill pipe 13 comprises a line 16 through which gasoline flows to the storage tank 10 and a concentric vapor recovery tube 17. The fill line 16 preferably extends into the storage tank with a terminus near the tank's bottom surface so as to minimize splashing and vapor formation during a filling operation. The vapor recovery tube leads into the storage tank, but normally terminates at the tank's top surface. As gasoline is pumped into the inner tank, gasoline vapors which are formed are sucked through the tube 17 back to the transport tank truck for recovery. This reduces the amount of gasoline vapors which would otherwise be vented to the atmosphere or remain in the inner tank preventing the tank from being filled completely with gasoline. As used throughout here, the term "fill pipe" connotes the pipe by which gasoline is pumped to the tank; it can be a single pipe, but more often has vapor recovery means associated with it and is often referred to as a vapor recovery fill line.

Dispensing line 14 is used for withdrawing gasoline and delivering it to the consumer through gasoline dispenser 18. While not illustrated in FIG. 1, a pump is positioned within the storage tank, dispensing line or gasoline dispenser for pumping gasoline to the dispenser. The bottom of the dispensing line 14 is in close proximity with the bottom of the storage tank 10. The vent pipe 15 provides means by which gasoline vapors resulting primarily from a filling operation can be vented to the atmosphere and prevents a vacuum from forming in the tank during a dispensing operation. The opening to the atmosphere is normally substantially off ground level for safety reasons. All the aforementioned pipes and lines are securely attached to the storage tank.

In accord with this invention, end plates 19 are mounted over each flattened end 12 of the storage tank and a jacket 20 covers the end plates and the main body. The end plates and jacket provide secondary containment for the liquid stored in the storage tank. The closed end spaces 21 and closed annular space 22 provide means by which any leakage of the storage tank, end plates or jacket can be detected.

The end plates are semi-rigid or rigid and serve the purpose of strengthening the formed outer jacket 20 as discussed below. The end plates preferably have a shape which approximates the shape and size of the flattened ends of the storage tank. It is preferred that the end plates be substantially the same size as the flattened ends of the tank. Smaller end plates down to those having an area of only 20% of the area of a tank's flattened end can be used. Most preferred, however, are those end plates which have an area equal to about 90% to about 101% of the area of the tank's flattened end.

Each end plate is mounted in a manner which results in a closed end space 21 between it and the flattened end 11 of the storage tank. The closed space 21 is segregated from the annular space 22 adjacent the side walls of the cylindrical-shape inner tank. As discussed more fully below, the spaces 21 are used a part of the leak detection system of the invention. A continuous weld 23 is preferably used to hold the end plates 19 to the inner tank 10. The welds are located around the edges of the end plates and spot welds are optionally used in the central portion. The use of the welds in the central portion has the added effect of strengthening the ends of the total tank system. Thus, a composite strengthening effect is achieved. Other mechanical means can as well be used to hold the end plates to the inner tank.

A separating agent is applied to the main body of the storage tank, extending preferably to the end plates. The purpose of the separating agent is to ensure that a subsequently applied fibrous reinforcing material and resinous material which form the jacket will not adhere to the inner storage tank or seal closed the annular space 22.

Figure 2:
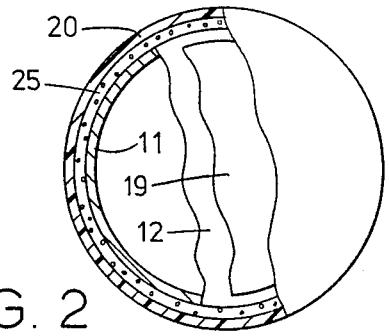
FIG. 2 is a end view of the storage tank of FIG. 1 with partial cut-aways showing the end plate and the tank's flattened end.

One desired separating agent is a wax material which can be subsequently heated and optionally removed so as to destroy any adhesion between the jacket and the underlying storage tank and consequently form the annular space. Another is a solid material which acts as a separating agent as well as a corrosion inhibiting agent, e.g. grease. Another preferred separating agent, shown in FIGS. 1 and 2, is a gas pervious material 25. Such materials are foraminous or porous and can take on various physical shapes and structures. Examples of such materials are mattings, nets, screens, and meshes. Specific examples are jute, polyurethane foam, polyester foam, fiberglass matting, cotton matting, nylon matting, corrugated cardboard, and asbestos. A heat seal or sealing material, e.g. a polymeric coating or film such as Mylar or a polyethylene, is used on one surface of the gas pervious material when needed to prevent substantial saturation by a subsequently applied resinous material as discussed in the following paragraphs. Another solid material which acts as a separating agent is a sheet material with surface irregularities placed towards the inner tank shell. A porous standoff material can also be placed on the tank shell and then wrapped with a solid material such as tape. Sheets or rolls of fiberglass reinforced resin or metal can also be utilized as a separating agent.

Jacket 20 is a fibrous reinforced resinous material. It is formed by applying a layer of fibrous reinforcing material on gas pervious material 25 found on storage tank 10. The fibrous reinforcing material can take on many different physical shapes and structures variously referred to as mattings, nets, screens, meshes, filament winding strands, and chopped strands. Examples of fibrous materials include fiberglass, nylon, and other synthetic fibrous materials. The fibrous material, if in a sheet form, can be laid onto the storage tank as a continuous matting.

A resinous material is also applied to the tank and thereafter cured. Several different resinous materials are known for the purpose of reinforcing fibrous material. Such materials include polyesters, e.g. vinylesters, isophthalic polyesters, polyethylene, polypropylene, polyvinylchloride, polyurethane, and polyepoxide. The listed resinous materials used in the construction of this jacket are not all inclusive, but only illustrative of some of the resinous materials which can be used. As an alternative, and in fact preferably, the fibrous material is applied in the form of chopped strands with the resinous materials described in the previous paragraph. That is, the chopped strand and resinous material are sprayed from separate nozzles of the same spray gun and the jacket formed therefrom on the separating agent as the resin cures.

Still another method of forming the jacket uses filament windings. Continuous reinforcing fibrous strands are impregnated with the resinous material and then wrapped around the separating material-covered inner tank in a crossing pattern. Other known methods of forming a fibrous reinforced resin substrate can be used.

The shape of the resultant jacket is such that it encases the main body side walls of the storage tank to form a closed annular space 22. The jacket also completely covers the end plates 19 and is preferably securely adhered thereto. The jacket formed around the cylinder part of the tank is preferably less than about 2 inches from the inner tank cylinder, more preferably from about ½ inches to about 1/32 of an inch. The jacketed end plate is preferably less than about 12 inches from the inner tank's flattened end, more preferably from about ½ inch to less than about 1/32 of an inch thereby allowing just enough space for detection of any leaked liquid which is stored in the storage tank. The jacket itself is capable of containing any liquid which is stored in the storage tank and which has leaked therefrom. The strength of the jacket has sufficient structural integrity to withstand external or internal load forces normally encountered by underground storage tanks without suffering cracking or collapsing. As used herein, cracking is defined to mean the jacket structurally tears apart to the extent a liquid will at least seep there through. Slight surface deformations can be tolerated; however, deflections of greater than about two inches from the norm would be considered a collapse. Preferably, the jacket is rigid and will not noticeably crack or collapse when external or internal load forces are encountered during normal use.

The end plates and jacket over the storage tank create three independent containment areas. One advantage of such a system is that any leakage will be isolated and thereby minimized. As discussed below, the use of the independent closed spaces also helps to locate the source of any leak.

Figure 3:
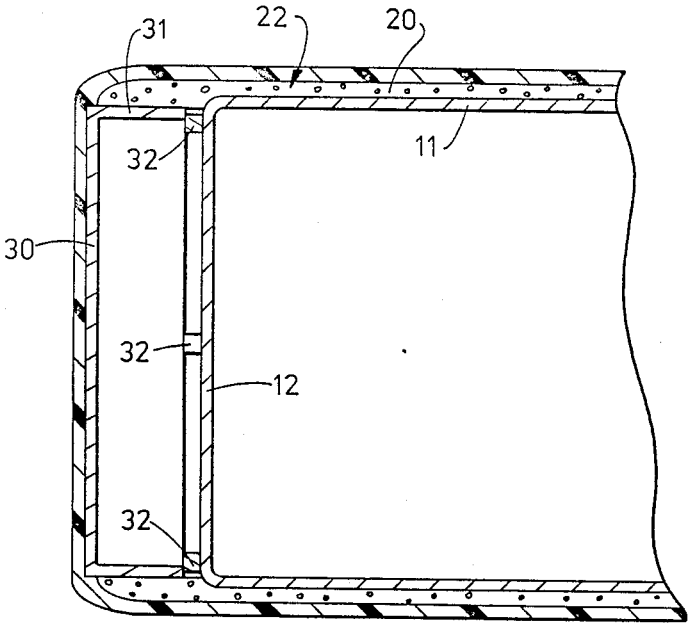
FIG. 3 is a partial side view of a cylindrical-shaped storage tank having an alternative end plate mounted thereon with a jacket of a fibrous reinforced resinous material.
Figure 4:
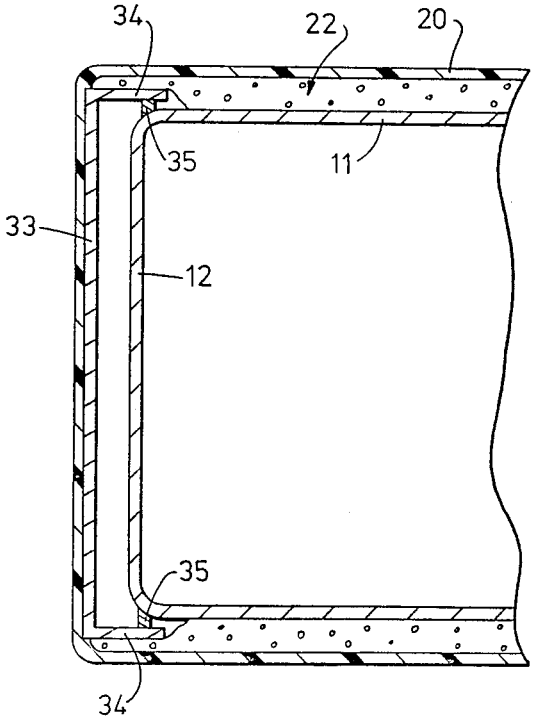
FIG. 4 is a partial side view of a cylindrical-shaped storage tank of this invention illustrating the use of still another end plate design.

FIGS. 3 and 4 illustrate alternative end plates which can be used. In FIG. 3, end plate 30 has a flange 31 which extends from the periphery of the end plate. The flange itself has welds 32 to hold it to the inner tank. Depending on the length of the flange, a closed space of from about 2 inches to about 12 inches is provided. The flange abuts up against the very outer rim of the flattened end. As shown in FIG. 4, an end plate 33 has a flange 34 which overlaps the side walls of the tank. Welds 35 are provided to hold the end plates to the tank and also isolates the closed end space. Ease of installation dictates which end plate alternative is used.

Figure 5:
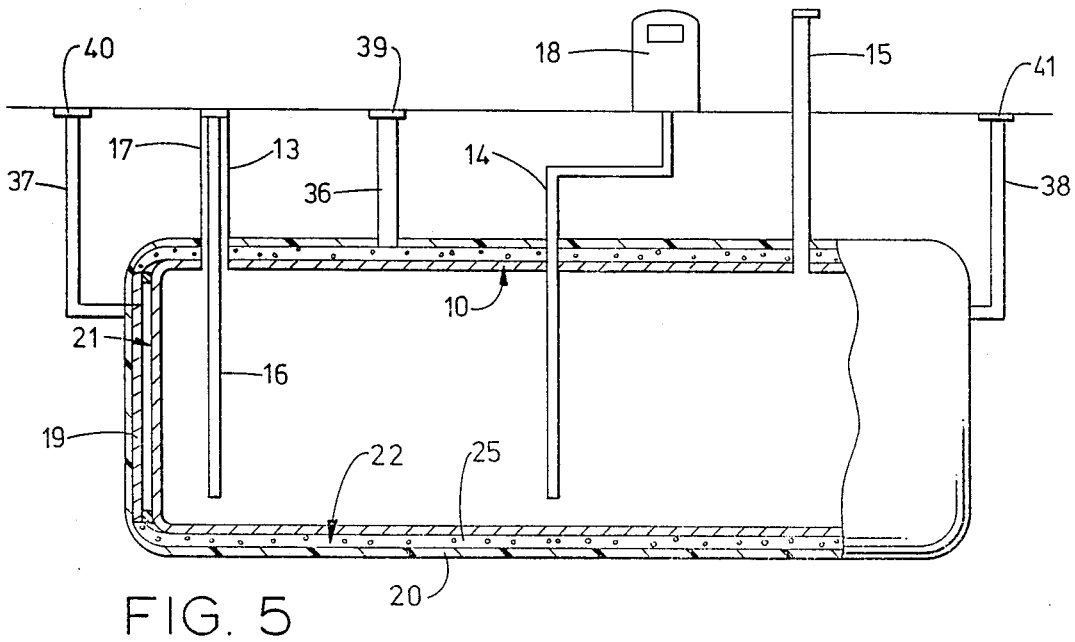
FIG. 5 is a side view of the cylindrical-shaped storage tank of FIG. 1 with a monitor means.

With reference to FIG. 5, the closed end spaces 21 and closed annular space 22 are monitored. As shown an access tube 35 extends from ground level through the jacket 20 so as to be in communication with the closed annular space. Separate access tubes 36 and 37 extend from ground level to the end plates so as to be in communication with each of the closed end spaces 21. The storage tank system of this invention is conducive to separate monitoring of the closed spaces. The obvious advantage of such a system is the ability to more readily locate the part of the storage tank or jacket which has developed a leak.

Any of several well known and commercially available monitor means are used. For example, the closed end spaces and annular space is filled with a detecting liquid. This detecting liquid can be placed in the closed space by the manufacturer of the tank due to the fact the closed space between the storage tank and jacket occupies a small volume, e.g. about 25–100 gallons detecting liquid is sufficient for use with a 20,000 gallon storage tank. At the end of each access tube are sight glasses 38, 39 and 40. Whenever leakage occurs, a change in the level or color of a detecting liquid will occur and will be readily observed in the sight glass. Instead of the sight glass and visual observation of a change in level or color of detecting liquid, non-visual leak detection means such as pressure transducers or float controls can be used to detect a change in level.

Alternatively, the closed spaces are placed either under a non- atmoshpheric pressure, i.e., a positive or negative air pressure. Detection means associated with the closed spaces is capable of detecting any change in pressure resulting from the leak in the jacket or the storage tank. A conventional air pump or vacuum pump, together with an associated pressure regulator are used. A pressure change sensor is a part of the detection means. A pressure gauge serves this purpose adequately. Optionally, an alarm system is electronically linked with the pressure sensor to audibly or visually warn of a preset significant pressure change. Gas pervious material 25 maintains a spaced relationship between the storage tank and the jacket when a vacuum is used as well as serves as the separating agent. Preferably, an access tube with strategically spaced holes extends from the air or vacuum pump to the lower portion of the closed space.

Another embodiment of the detection means utilizes an analyzer capable of detecting the liquid being stored. Thus, the detection means comprises the analyzer which is in communication with the closed space. Preferably, a vacuum means for withdrawing gaseous material from the closed spaces is used for the purpose of obtaining a sample. Thus, an analyzer capable of detecting selected liquids is used instead of a pressure change sensor.

Still another detection means utilizes a probe which extends through an access tube so as to monitor for leakage, preferably at or near the bottom of the closed spaces. The probe is capable of detecting pre-selected liquids or gases. In this embodiment, the separating agent can be a gas pervious material whereby leakage will ultimately seep to the bottom of the closed end or annular spaces and be detected or a solid which is stored liquid-, e.g., gasoline-soluble or water-soluble. Such solid separating agents will ultimately be solubilized and the leakage detected by the probe.

All the leak detection means discussed above can be electronically linked with an alarm system to audibly or visually warn of a pre-set significant change in the closed spaces. The leak detection means and secondary containment means allow for an early warning of a deterioration of either the primary or secondary containment means thereby permitting the necessary repair work to be done before any significant soil or water contamination has occurred.

The invention herein has been described with particular reference to the drawings. It should be understood other variations of the invention are within the scope of coverage. For example, inner storage tanks with a manway are useful herein. The manway can 1 be used to accommodate the various access liner, including a line for leak detection purposes.

What is claimed is:

1. A storage tank system for liquids having secondary containment capability, comprising:

(a) a cylindrical-shaped storage tank with substantially flattened ends for storing the liquid;

(b) an end plate mounted on each flattened end of the tank, said end plates mounted so that a closed space exists between the end plate and the tank;

(c) a separating agent on the side walls of the storage tank and any portion of the flatten tank ends not covered by an end plate; and (d) a jacket made of a fibrous reinforced resinous material which covers the surface area of the storage tank to form a closed space, said jacket being independent from the side walls of the storage tank because of the separating agent, having sufficient structural strength to contain liquid in the storage tank which may leak therefrom, and being capable of withstanding external or internal load forces normally encountered by underground storage tanks without suffering cracking and/or collapsing.

2. The storage tank system of claim 1 wherein the storage tank is a metal tank

3. The storage tank system of claim 1 wherein the end plates are substantially flat.

4. The storage tank system of claim 3 wherein each end plate has a flange around its periphery.

5. The storage tank system of claim 4 wherein the flange overlaps the side walls of the storage tank.

6. The storage tank system of claim 3 wherein spot welds are used to hold the end plates to the storage tank.

7. The storage tank system of claim 3 wherein fiberglass is used to reinforce the resinuous material.

8. The storage tank system of claim 3 wherein each end plate covers from about 90% to about 101% of the tank's flattened ends.

9. The storage tank system of claim 3 wherein the separating agent is a gas pervious material.

10. The storage tank system of claim 9 wherein a surface of the gas pervious material which is exposed to the resinous material is first sealed to prevent substantial penetration of the resinous material.

11. The storage tank system of claim 10 wherein the gas pervious material is sealed with a polymeric material.

12. The storage tank system of claim 10 wherein the gas pervious material is heat sealed.

13. The storage tanks system of claim 3 further comprising a leak detection means independently in communication with each of the closed end spaces and the closed annular space.

* * * * *